United States Patent [19]

Anderson et al.

[11] Patent Number: 4,631,771

[45] Date of Patent: Dec. 30, 1986

[54] CLOTHES WASHING MACHINES

[75] Inventors: Iain A. Anderson; Christopher J. Gaelic; Phillipa L. Elliott, all of Mt. Wellington, New Zealand

[73] Assignee: Fisher & Paykel Limited, Mt. Wellington, New Zealand

[21] Appl. No.: 706,027

[22] Filed: Feb. 26, 1985

[30] Foreign Application Priority Data

Feb. 29, 1984 [NZ] New Zealand ..... 207316
Feb. 29, 1984 [NZ] New Zealand ..... 207319

[51] Int. Cl.[4] ..... D06F 33/02

[52] U.S. Cl. ..... 8/158; 8/159; 68/12 R; 68/23.5; 68/23.7

[58] Field of Search ..... 8/158, 159; 68/12 R, 68/23 R, 23.5, 23.7, 24, 53, 148, 207

[56] References Cited

U.S. PATENT DOCUMENTS

| | | | |
|---|---|---|---|
| 2,432,766 | 12/1947 | Kirby | 68/148 X |
| 2,706,899 | 4/1955 | Meyer | 68/23.5 |
| 2,986,913 | 6/1961 | Condit et al. | 68/23.7 X |
| 3,194,398 | 7/1965 | Fecho | 68/24 X |
| 4,175,409 | 11/1979 | Morey | 68/27 X |
| 4,517,695 | 5/1985 | Hoffmann et al. | 8/158 |

*Primary Examiner*—Philip R. Coe
*Attorney, Agent, or Firm*—Christie, Parker & Hale

[57] ABSTRACT

A clothes washing machine includes a container within which a spin tub is rotatably mounted, an agitator mounted within that spin tub, driving means including a reversible electric motor to drive the spin tub and agitator, and controls are provided to cause the spin tub to commence a spinning phase of the clothes washing cycle, to cause the spin tub and its contents to accelerate through the critical speed (lateral resonance speed) to a holding speed not greatly above that critical speed, and to cause that holding speed to be maintained for a sufficient length of time as to prevent or substantially reduce the creation of suds or foam caused by cleaning additives such as detergents in the washing liquid until conditions for suds forming have been substantially eliminated.

Alternatively or additionally a hot water admission water valve and a cold water admission valve are provided and further controls to control motion of the clothes in association with control of the hot water admission valve in a manner such that the clothes are slowly or gently moved during admission of hot water into the container of the laundry machine.

23 Claims, 2 Drawing Figures

CLOTHES WASHING MACHINES

Figure 1:
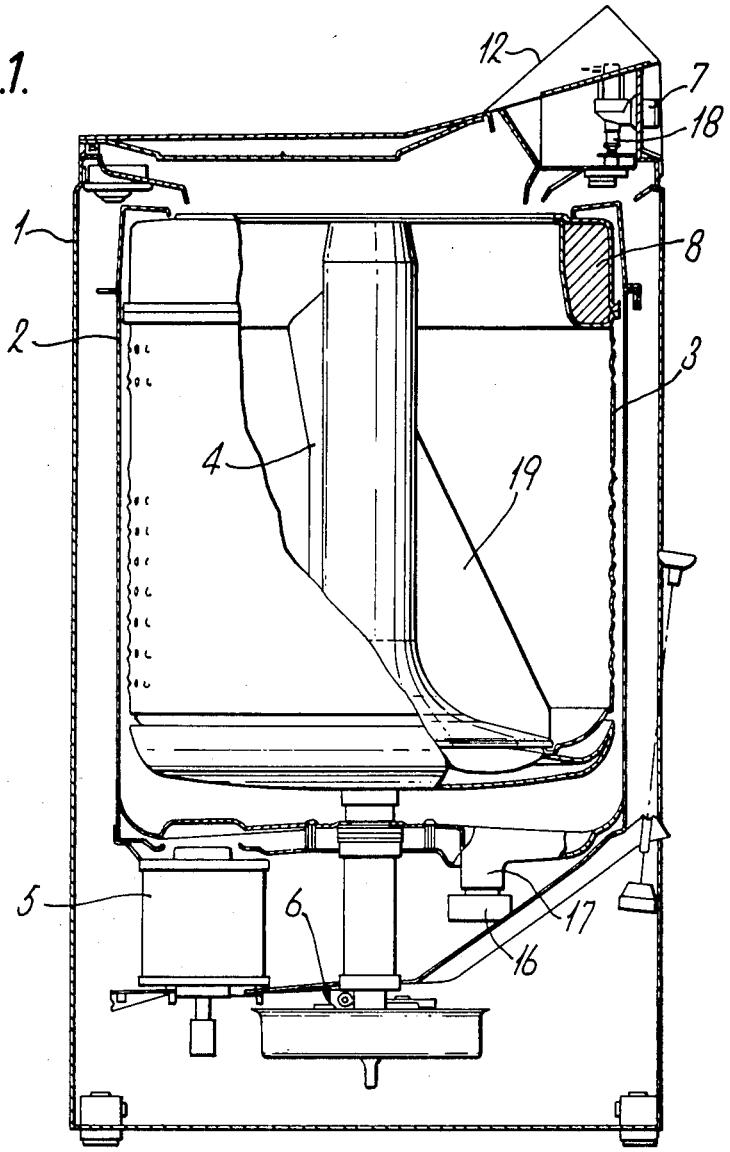

This invention relates to clothes washing machines and methods of operating the same.

It is an object of the present invention to provide a laundry machine which will at least provide the public with a useful choice.

Accordingly in one aspect the invention consists in a method of operating a clothes washing machine of the type which includes a container within which a spin tub is rotatably mounted, an agitator mounted within the spin tub, driving means including a reversible electric motor to drive said spin tub and agitator, a hot water admission water valve and a cold water admission valve, through which hot and cold water respectively are admitted to said container, said method including the step of slowly or gently rotating the spin tub or slowly or gently agitating clothes in the container during the time when the hot water valve is opened.

In a further aspect the invention consists in a clothes washing machine of the type which includes a container within which a spin tub is rotatably mounted, an agitator mounted within the spin tub, driving means including a reversible electric motor to drive said spin tub and agitator, a hot water admission water valve and a cold water admission valve, wherein control means are provided to control motion of the clothes in association with control of the hot water admission valve in a manner such that the clothes are slowly or gently moved during admission of hot water into the container of the laundry machine.

In a still further aspect this invention consists in a method of operating a clothes washing machine of the type which includes a container within which a spin tub is rotatably mounted, an agitator mounted within that spin tub, driving means including a reversible electric motor to drive said spin tub and agitator, said method including the steps of causing said spin tub to commence a spinning phase of the clothes washing cycle, accelerating the spin tub and its contents through the critical speed (lateral resonance speed) to a holding speed not greatly above that critical speed, and holding the speed at that holding speed for a sufficient length of time as to prevent or substantially reduce the creation of suds or foam caused by cleaning additives such as detergents in the washing liquid until conditions for suds forming have been substantially eliminated.

In a still further aspect the invention consists in a clothes washing machine of the type which includes a container within which a spin tub is rotatably mounted, an agitator mounted within that spin tub, driving means including a reversible electric motor to drive said spin tub and agitator, wherein control means are provided to cause said spin tub to commence a spinning phase of the clothes washing cycle, to cause the spin tub and its contents to accelerate through the critical speed (lateral resonance speed) to a holding speed not greatly above that critical speed, and to cause that holding speed to be maintained for a sufficient length of time as to prevent or substantially reduce the creation of suds or foam caused by cleaning additives such as detergents in the washing liquid until conditions for suds forming have been substantially eliminated.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Figure 2:
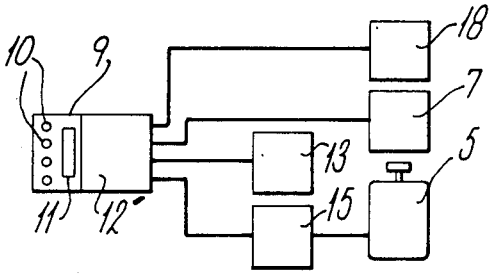

One preferred form of the invention will now be described with reference to the accompanying drawings in which, FIG. 1 is a cross section of a clothes washing machine constructed according to the invention and, FIG. 2 is a block diagram of a control circuit used in the machine of FIG. 1.

Referring to the drawings, in the preferred form of the invention a clothes washing machine is provided having an outer casing 1, a waterproof drum shaped container 2 within that casing, there being a rotatable bowl shaped spin tub 3 within the container and an agitator 4 also rotatable within the spin tub. The spin tub is preferably, though not necessarily a castellated drum as described in our U.S. Pat. No. 4,392,372. Driving means including a reversible electric motor 5 are provided which enable the agitator to be driven in a back and forth motion, usually over less than 2TT radians and an interconnecting means 6 arranged so that when the agitator is driven continuously in one direction, the agitator drive mechanism picks up a drive to the spin tub to rotate the agitator, the spin tub and clothes contained within the spin tub at a desired speed. A balancing ring 8 is provided mounted on the upper inner edge of the spin tub 3.

A drain is provided from the container and water admission means also provided, comprising electrically actuated valves one of which referenced 7, controls admission of hot water into the container and the other referenced 18 which controls admission of cold water.

Control means for controlling the various cycles of operation preferably comprise a control box 9, FIG. 2, having user operable controls 10 such as manual switches and a display 11 and having or controlling electronically actuated switching means mounted on a console panel 12 of the laundry machine and an associated microprocessor 12' which is preferably also mounted in the control box 9. A separate microprocessor 13 is provided which includes or controls electronically actuated swtiching means which accepts instructions from microprocessor 12' and operate the motor 5 according to such instructions. The valve 7 and valve 18 are also actuated through instructions from microprocessor 12'. The above control means control the water admission valves and the drive system in a manner such as to include the following sequence of events.

On an appropriate user operable control 10 being operated, a circuit is completed by the microprocessor 12' to enable a supply of hot water through valve 7 to be effected. The circuit also instructs the microprocessor 13 to energise the motor 5 to either rotate slowly e.g. at a speed sufficient to rotate the agitator and therefore the spin tub 3 at about 20 R.P.M. or to oscillate the agitator to give a slow or gentle agitation corresponding in movement for example to rotation at a speed lower than the first critical speed e.g. rotation at about 20 R.P.M.

It is known that with certain delicate fabrics the admission of hot water direct from the hot water supply particularly if that water is at a temperature of say 80° C. or above can cause damage to those delicate fabrics. Accordingly, the control means according to the present invention are arranged so that when the hot water admission valve is open then the spin tub is caused to revolve at a suitable speed, for example, the above suggested 20 R.P.M. with the result that any delicate fabrics in the spin tub at the time the hot water valve is open will be moved under and away from the jets or spray of water entering from the hot water admission system. In this way because any delicate fabrics are only intermittently exposed to the hot water, the risk of damage to such delicate fabrics is at least reduced if not eliminated.

The advantages of this arrangement will be considerable. By a very simple control step readily provided in the control program of the washing machine, the risk of damage to delicate fabrics caused in present apparatus by allowing hot water to flow directly onto the fabrics during filling of the container is considerably reduced if not eliminated.

The present invention also envisages actuation of the control means above described with reference to FIG. 2 to control the spinning cycle as follows. When a washing i.e. agitating phase has been completed, the microprocessor 12' instructs the microprocessor 13 to cause the motor 5 to operate continuously in the same direction and to operate a solenoid 15 to cause the valve and or pump 16 in a drain 17 to open a drain washing liquid out of the container 2. If the spin phase is also to include rinsing, the cold water valve 18 also controlled by the microprocessor is also operated to supply water onto the vanes 19 of the rotating agitator 4 which causes the water to be sprayed onto the clothes. After the free water in container 2 has been substantially preferably completely drained off, the draining being effected between castellations in the bottom of the spin tub 3, the microprocessor 13 causes the motor 5 to accelerate the spin tub 3 as rapidly as possible to a first spinning speed of between 50 and 100 R.P.M. and preferably about 70 R.P.M. and this speed is maintained for a first period of time e.g. between 10 and 120 seconds preferably about 30 seconds. Because of the wet clothes and the water in the spin tub 3 (if any) the critical speed (the lateral resonance speed) of the spin tub 3 and its contents including water and the balancing ring 8 is about 40–60 R.P.M. e.g. 50 R.P.M. so that this speed is moved through rapidly. The speed of about 70 R.P.M. also enables out of balance motion of the spin tub to be detected, and if necessary, the spinning process is shut down. After the say 10–120 second delay, preferably 30 seconds the speed is increased to between 250 and 350 R.P.M. preferably about 300 R.P.M. which is held for a second period of time e.g. about 10 seconds with the drain 17 open, and if operating conditions are favourable the speed taken up to full spin speed of 1100 R.P.M.

The control of speed at least in the preferred form to the first holding speed of about 70 R.P.M. enables the washing liquid including cleaning additives such as detergents to be relatively undisturbed resulting in only small amounts of suds or foams forming. With conventional machines as at present available, suds are formed in such volume that "suds locking" occurs, i.e. the friction of the suds between the container and the spin tub is so great that the motor cannot take the spin tub up to spin speed without at least reduction in spinning efficiency and perhaps resulting in a burnt out motor due to overload.

By this apsect of the invention, at least in the preferred form, holding the initial spinning speeds to lower levels permits draining and if desired rinsing to occur under suitable conditions to reduce suds formation.

In the preferred form, the motor 5 is provided with low speed and high speed windings. The microprocessor 13 causes power to be supplied to the low speed windings to accelerate the spin tub speed from the first holding speed of about 70 R.P.M. up to about 300 R.P.M. Sensing means are provided to sense whether this speed is attained within a substantially predetermined time. If it is not attained this indicates excessive friction or resistance probably due to suds locking and power to the motor is cut. If it is attained, rotation at about 300 R.P.M. is maintained for about 10 seconds and connections are changed by the microprocessor 13 from the low speed motor windings to the high speed motor windings and power supplied to the high speed windings to attempt to maintain the about 300 R.P.M. speed for a further period of about 20 seconds. However the motor torque resulting from energizing the high speed windings is sufficient to maintain the spin tub speed of about 300 R.P.M. only if there is no high frictional loading due for example to suds locking. If the second spin up speed of 300 R.P.M. is not maintained within a predetermined time, this failure in performance is sensed, the sensed information processed by the microprocessor 13 and the supply of power to the motor cut off.

Thus the microprocessor 13 and the motor 5 are designed so that in the event of suds locking occurring before the run up to the full spinning speed, that speed is not in fact achieved and the microprocessor senses such lack of speed and shuts the motor down.

After stopping, any one of a series of further actions are possible, for example:

1. The machine may be left inactivated, leaving it to the operator to go through a restart sequence.

2. Restarting of spinning may be effected automatically, going through the first holding speed cycle perhaps for say two or three times and if loads causing excessive friction still exist then operator actuation brought into operation.

3. An agitation cycle including adding water and washing and/or rinsing may be recommended automatically for a predetermined duration in an attempt to reduce the detergent content of the washing liquid then spinning is again attempted.

4. Combinations of these or other sequences may be used.

Additionally holding a second spinning speed of about 300 R.P.M. results in some water being spun out of the clothes at a still relatively gentle rate again to obviate or reduce the formation of suds or foam.

What is claimed is:

1. A method of operating a clothes washing machine of the type which includes a container within which a spin tub is rotatably mounted, an agitator mounted within that spin tub, driving means including a reversible electric motor energized to drive said spin tub and agitator, said method comprising the steps of causing said spin tub to commence a spinning phase of the clothes washing cycle, accelerating the spin tub and its contents through the critical speed (lateral resonance speed) to a holding speed not greatly above that critical speed, and holding the speed at that holding speed for a sufficient length of time as to prevent or substantially reduce the creation of suds or foam caused by cleaning additives such as detergents in the washing liquid until conditions for suds forming have been substantially eliminated, applying increased power to said motor after said sufficient length of time has expired to accelerate said spin tub towards a further speed lower than a full spin speed, sensing whether there is excessive friction resisting attaining or maintaining said further speed under available motor torque from the energized motor and then effecting further steps selected from either the step of maintaining said further speed, when attained, for a period of about 10 seconds and subsequently applying further increased power to said motor to cause the full speed spinning for a desired period of time and subsequently stopping spinning, or the step of switching off power to said motor in the event that said further speed is not reached or maintained under said available motor torque.

2. A method as claimed in claim 1 using a clothes washing machine which has a hot water admission water valve and a cold water admission valve, through which hot and cold water respectively are admitted to said container, said method including the step of slowly or gently rotating the spin tub or slowly or gently agitating clothes in the container during the time when the hot water valve is opened.

3. A method as claimed in claim 1 which includes the step of holding said holding speed for a period of between 10 and 120 seconds.

4. A method as claimed in claim 1 which includes the step of holding said holding speed for about 30 seconds.

5. A method as claimed in claim 1 which includes the step of controlling said holding speed to about 70 R.P.M.

6. A method as claimed in claim 1 using an electric motor having low speed and high speed windings said method including the steps of changing power connections from said low speed windings to said high speed windings, said high speed windings being such that the further speed is only attained if the frictional resistance to acceleration is below a substantially predetermined figure.

7. A method as claimed in claim 1, 3, 4, 5 or 6 additionally comprising a step selected from the steps of (a) leaving restarting of the preceding recited steps to an operator;

(b) restarting of the spinning phase automatically repeating any of the steps of
1. accelerating the spin tub,
2. holding the speed,
3. applying increased power,
4. sensing the speed, and
5. effecting further steps;

(c) restarting an agitation cycle in which the agitator is reciprocally operated for a predetermined period and subsequently repeating the steps of
1. commencing the spinning phase,
2. accelerating the spin tub,
3. holding the speed,
4. applying increased power,
5. sensing the speed, and
6. effecting further steps;

(d) a combination of steps (a) to (c).

8. A clothes washing machine of the type which includes a container within which a spin tub is rotatably mounted, an agitator mounted within that spin tub, driving means including a reversible electric motor to drive said spin tub and agitator, wherein control means including sensing means are provided to cause said spin tub to commence a spinning phase of the clothes washing cycle, to cause the spin tub and its contents to accelerate through the critical speed (lateral resonance speed) to a holding speed not greatly above that critical speed, and to cause that holding speed to be maintained for a sufficient length of time as to prevent or substantially reduce the creation of suds or foam caused by cleaning additives such as detergents in the washing liquid until conditions for suds forming have been substantially eliminated, said control means causing said motor to be actuated to accelerate said spin tub after said sufficient length of time toward a further speed which is lower than the full spin speed, said sensing means sensing whether said further speed is attained within a predetermined time, attainment of said further speed resulting in said control means being actuated to cause said spin tub to be accelerated to full spin speed after holding said further speed for about 10 seconds and lack of said attainment resulting in said control means being actuated to switch off power to said motor.

9. A clothes washing machine as claimed in claim 8 including a hot water admission water valve and a cold water admission water valve and wherein said control means is adapted to control motion of the clothes in association with control of the hot water admission valve in a manner such that the clothes are slowly or gently moved during admission of hot water into the container of the laundry machine.

10. A clothes washing machine according to claim 9 wherein said control means comprise switching means arranged to energize said electric motor when said hot water admission valve is opened.

11. A clothes washing machine as claimed in claim 8 wherein said control means control said motor to hold said holding speed for a period of between 10 and 120 seconds.

12. A clothes washing machine as claimed in claim 8 wherein said control means hold said holding speed for a period of about 30 seconds.

13. A clothes washing machine as claimed in claim 8, wherein said control means hold said holding speed to about 70 R.P.M.

14. A clothes washing machine as claimed in claim 8, wherein said control means cause said motor to be actuated to accelerate said spin tub after said sufficient length of time to a further speed of between 250 and 350 R.P.M. preferably 300 R.P.M. before accelerating said spin tub to full spin speed and holding said further speed for a period of about 10 seconds.

15. A clothes washing machine as claimed in claim 8 wherein said electric motor has low speed and high speed windings and said control means change power connections from said low speed windings to said high speed windings, said high speed windings being such that said desired criterion is only attained if the frictional resistance to acceleration is below a substantially predetermined figure.

16. A clothes washing machine as claimed in claim 9, 10, 8, 11, 12, 13, 14 or 15 comprising operation means for causing operation of the machine selected from (a) leaving restarting of the preceding recited operation to an operator, (b) restarting of the spinning phase automatically repeating any of the previously recited operations of
1. causing the spin tub to accelerator to the holding speed;
2. causing the holding speed to be maintained;
3. causing said motor to be actuated to be accelerated;
4. causing said sensing machine to sense;
5. actuating the contact means to cause full spin speed upon such attainment;
6. actuating the contact means to switch off power, (c) restarting an agitation cycle in which the agitator is reciprocally operated for a predetermined period and subsequently automatically repeating the recited operations of 1. causing the spin tub accelerator to the holding speed;
2. causing the holding speed to be maintained;
3. causing said motor to be actuated to be accelerated;
4. causing said sensing machine to sense;
5. actuating the contact means to cause full spin speed upon such attainment;
6. actuating the contact means to switch off power, (d) a combination of steps (a) to (c) and said operation means are actuated after non attainment of said further speed and after switching off of power to said motor following said non attainment.

17. A method as claimed in claim 1 wherein said further speed is in the range of about 250 to 350 R.P.M.

18. A method as claimed in claim 22 wherein said holding speed is about 50 to 100 R.P.M.

19. A method as claimed in either claim 17 or 18 wherein said full spin speed is about 1100 R.P.M.

20. A clothes washing machine as claimed in claim 8 wherein said further speed is in the range of about 250 to 350 R.P.M.

21. A clothes washing machine as claimed in claim 20 wherein said holding speed is about 50 to 100 R.P.M.

22. A clothes washing machine as claimed in claim 20 or 21 wherein said full spin speed is about 1100 R.P.M.

23. A method of operating a clothes washing machine of the type which includes a container within which a spin tub is rotatably mounted, an agitator mounted within that spin tub, driving means including a reversible electric motor energized to drive said spin tub and agitator, said method comprising the steps of causing said spin tub to commence a spinning phase of the clothes washing cycle, accelerating the spin tub and its contents through the critical speed (lateral resosance speed) to a holding speed not greatly above that critical speed, and holding the speed at that holding speed for a sufficient length of time as to prevent or substantially reduce the creation of suds or foam caused by cleaning additives such as detergents in the washing liquid until conditions for suds forming have been substantially eliminated, applying increased power to the said motor after said sufficient length of time has expired to accelerate said spin tub towards a further speed lower than a full spin speed, sensing the speed of the spin tub to sense whether said further speed is attained in a substantially predetermined time and then effecting further steps selected from the steps of maintaining said further speed, when attained, for a period of about 10 seconds and subsequently applying further increased power to the motor to cause the full speed spinning, for a desired period of time and subsequently stopping the spinning and switching off power to said motor in the event that said further speed is not reached in said substantially predetermined time.

* * * * *